US010937402B1

(12) United States Patent
Geraghty

(10) Patent No.: US 10,937,402 B1
(45) Date of Patent: Mar. 2, 2021

(54) STRING INSTRUMENT HEADSTOCK BRACE APPARATUS

(71) Applicant: AmpRx LLC, New Market, MD (US)

(72) Inventor: Patrick Geraghty, New Market, MD (US)

(73) Assignee: AmpRx, LLC, New Market, MD (US)

( * ) Notice: Subject to any disclaimer, the term of this patent is extended or adjusted under 35 U.S.C. 154(b) by 0 days.

(21) Appl. No.: 16/831,992

(22) Filed: Mar. 27, 2020

Related U.S. Application Data

(60) Provisional application No. 62/944,482, filed on Dec. 6, 2019.

(51) Int. Cl.
*G10G 7/00* (2006.01)
*G10D 3/06* (2020.01)

(52) U.S. Cl.
CPC ..... *G10G 7/00* (2013.01); *G10D 3/06* (2013.01)

(58) Field of Classification Search
CPC ..... G10D 3/13; G10D 3/147; G10D 1/08
See application file for complete search history.

(56) References Cited

U.S. PATENT DOCUMENTS

| | | | | |
|---|---|---|---|---|
| 2,128,460 | A | 8/1938 | Harlin | |
| 4,829,870 | A | 5/1989 | Ralston | |
| 6,515,209 | B2 | 2/2003 | Pittman | |
| 7,465,859 | B2 | 12/2008 | Kroeger et al. | |
| 7,560,630 | B1 * | 7/2009 | Keenan, Jr. ..... | G10D 3/00 84/290 |
| 7,842,868 | B2 | 11/2010 | Else | |
| 10,008,189 | B1 | 6/2018 | Baldemor | |
| 10,278,855 | B2 | 5/2019 | Salido | |
| 2017/0018263 | A1 | 1/2017 | Visesnut et al. | |

* cited by examiner

*Primary Examiner* — Kimberly R Lockett
(74) *Attorney, Agent, or Firm* — U. Maryland Baltimore Carey School of Law MIPLRC/IPEC

(57) ABSTRACT

A string instrument headstock and headstock-neck region brace apparatus. Such an apparatus may be used to strengthen, protect, and brace the region on a string instrument, guitar, violin, mandolin, banjo, etc. where the headstock meets the neck. The apparatus cradles the underside of the string instrument with a relatively strong material. Simultaneously, the apparatus applies a force to the instrument headstock countering the stress and strain produced by the tension in the instrument strings; and the apparatus secures, braces and holds the headstock in the relatively strong brace.

12 Claims, 5 Drawing Sheets

STRING INSTRUMENT HEADSTOCK BRACE APPARATUS

CROSS-REFERENCE

This patent application claims priority to U.S. Provisional Application No. 62/944,482, filed on Dec. 6, 2019, which is included herein by reference in its entirety.

BACKGROUND

String instruments, guitars, violins, mandolins, banjos, etc., are tuned by tensioning the strings between the instrument body and headstock. The tension in the strings produce a force pulling forward on the instrument headstock—where the strings terminate at the tuning machines. Additionally, the narrowing transition between the instrument neck and headstock creates a weak region susceptible to fractures and separation where the neck meets the headstock—the headstock-neck region. The region of high stress, as well as the force produced by the tension in the strings, can cause breaks at the headstock-neck region and in the headstock. This problem is exacerbated by rough handling or transportation. Therefore, an apparatus is needed to strengthen and protect the headstock and headstock-neck region of a string instrument to prevent breaks therein.

BRIEF DESCRIPTION OF THE FIGURES

Advantages of embodiments of the present invention will be apparent from the following detailed description of exemplary embodiments thereof, which description should be considered in conjunction with the accompanying drawings in which.

DETAILED DESCRIPTION

An instrument headstock brace apparatus according to a non-exhaustive number of embodiments of the invention will be described. The description will be done in reference to the accompanying drawings, wherein like numerals indicate like elements.

As used herein, the word "exemplary" means "serving as an example, instance or illustration." The embodiments described herein are not limiting but, rather, exemplary only.

According to an embodiment, and referring to the figures generally, a string instrument (e.g., guitar, violin, or mandolin) headstock brace apparatus may be described. According to an embodiment, such an apparatus may enable a user to brace and protect from breaking a string instrument headstock, as well as the region on a string instrument where the instrument headstock meets the instrument neck—the headstock-neck region. In embodiments the apparatus may attach to, and brace, a string instrument at the headstock-neck region. Also, in embodiments, the apparatus may attach and detach from an instrument without the use of tools.

Further, in embodiments, the use of tools may be required to attach and detach the apparatus from an instrument.

Figure 1A:
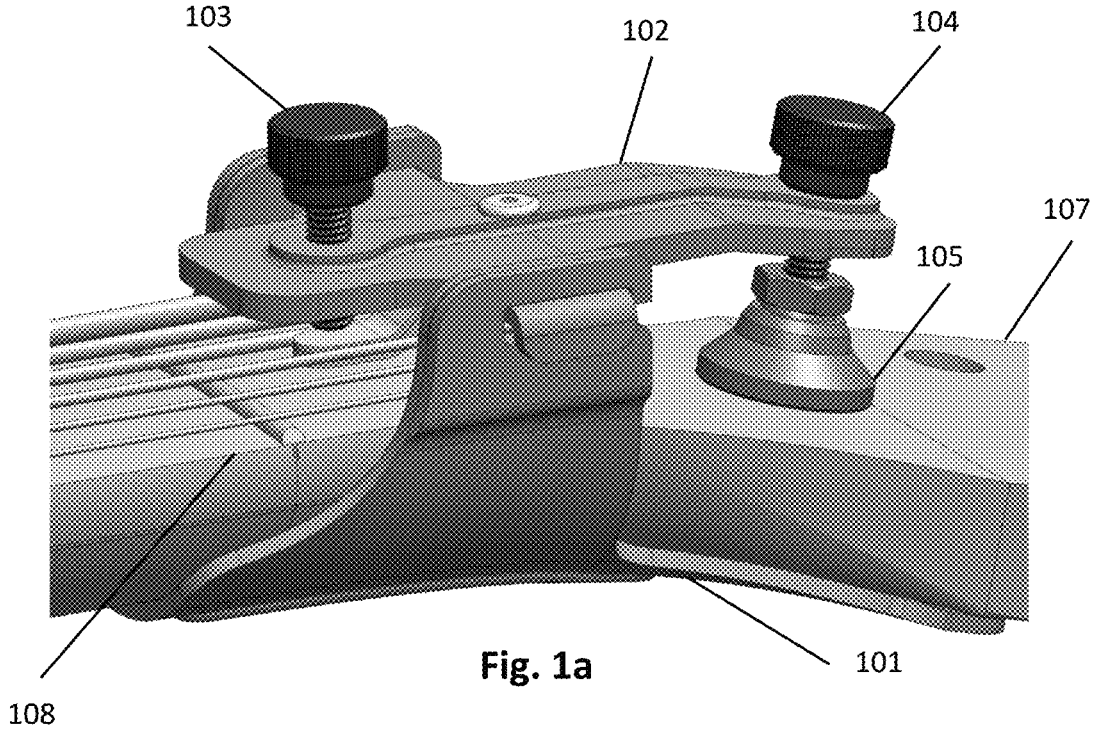
FIG. 1*a* shows an exemplary embodiment of an instrument headstock brace apparatus in the context of use.
Figure 1B:
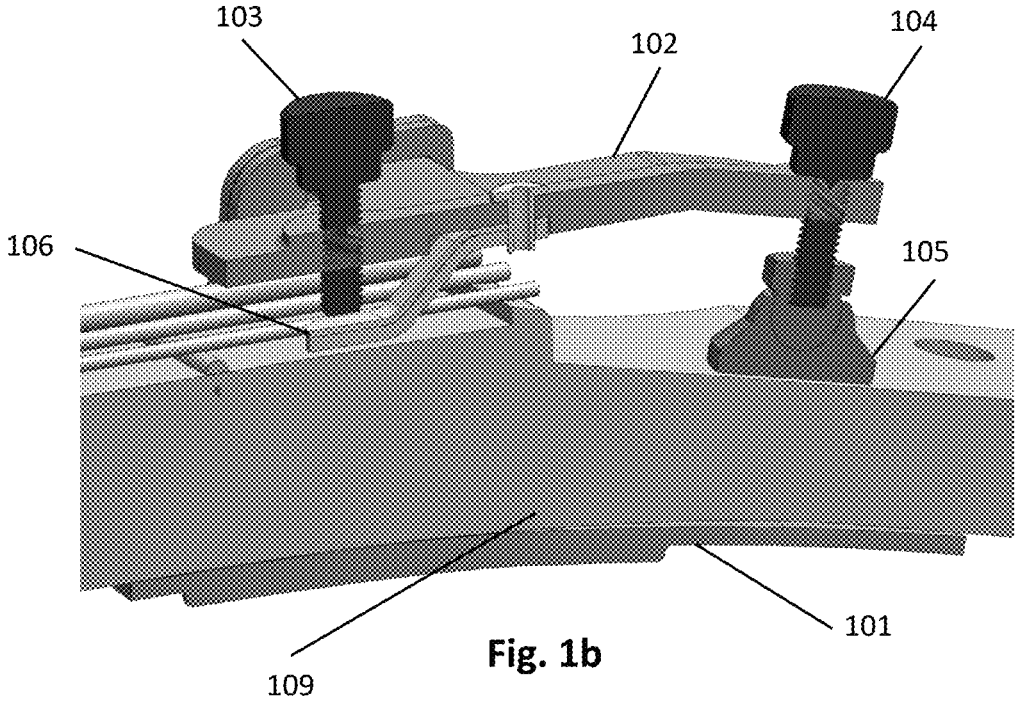
FIG. 1*b* shows a cross section view of an exemplary embodiment of an instrument headstock brace apparatus in the context of use.

FIGS. 1*a*-1*b* show various views of an exemplary embodiment of an instrument headstock brace apparatus. In particular, FIG. 1*a* shows an exemplary embodiment of a brace apparatus in the context of use on a string instrument. According to an exemplary embodiment, the apparatus may consist of two members: a lower member, or receiver 101; and an upper member, or torque cap 102. The lower member 101 and upper member 102 may meet and join above a string instrument.

According to an exemplary embodiment, the upper member 102 may contain two screws: a first screw 103 near the top of an instrument's fingerboard; and a second screw 104 at an instrument's headstock. The two screws may be tightened to relieve the strain in the headstock and headstock-neck region caused by the tension in the instrument strings. Further, in an embodiment, upon installation, the apparatus may act as a brace to strengthen and stabilize the headstock 107 and headstock-neck region 109.

Figure 2A:
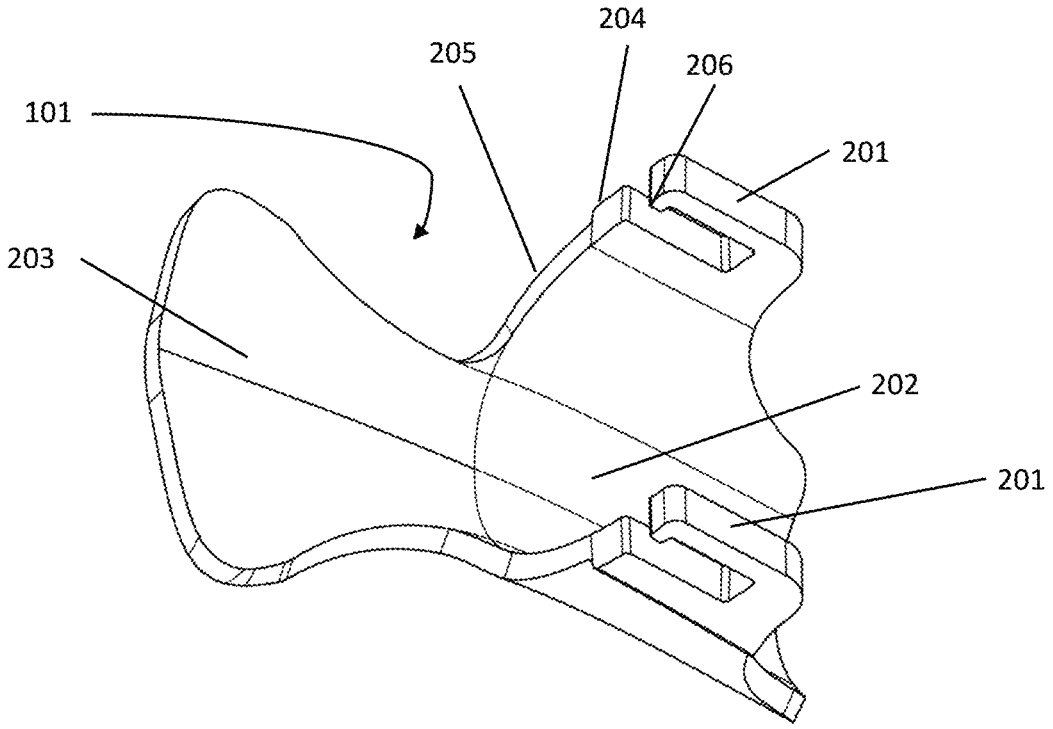
FIGS. 2*a*-2*d* show various views of an exemplary embodiment of a lower member ("Receiver") of an instrument headstock brace apparatus.

FIGS. 2*a*-2*d* show multiple views of an embodiment of a lower member 101 of an instrument headstock brace apparatus. In particular, FIG. 2*a* shows a perspective view of the top side of an embodiment of a lower member 101 of an instrument headstock brace apparatus. According to an embodiment, the lower member 101 may run along the underside of a string instrument from the upper neck 108 into the headstock 107. The lower member 101 may encompass two regions, a cradle region 202 and a tongue region 203. The cradle region 202 may be shaped to fit around, and cradle, the underside of the upper portion of a string instrument neck. The tongue region 203 may extend from the cradle region 203, extending toward the top of the string instrument, and may be shaped to receive the underside of the instrument headstock 107.

In an embodiment, the cradle region 202 may have two upward extensions 205, one on either side of the instrument neck, which terminate in notches 201 above the instrument strings. The notches 201 may receive the upper member 102. In an embodiment, the notch regions 204 may be manufactured of thicker material than the rest of lower member 101 to better withstand the stress applied to them upon apparatus installation.

In an embodiment, the notches 201 may each contain a locking catch 206. Upon installation, the upper member 102 may press firmly against the notches 201 within the locking catches 206. The locking catches 206 may prevent the upper member 102 from moving longitudinally within the lower member 101.

Figure 2B:
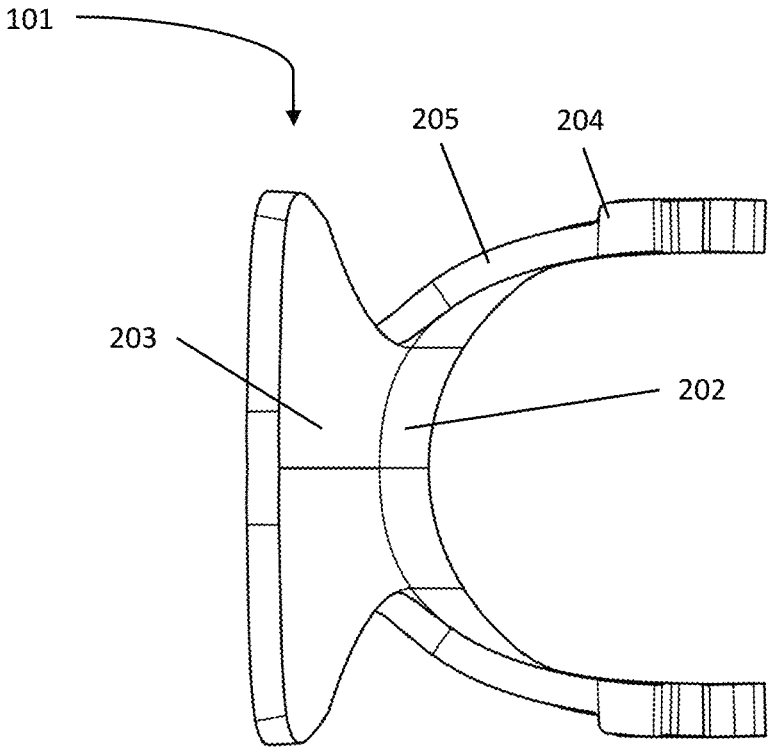

FIG. 2*b* shows an end view of an embodiment of a lower member 101 showing a cradle region 202, a tongue region 203, extensions 205, and notch regions 204.

Figure 2C:
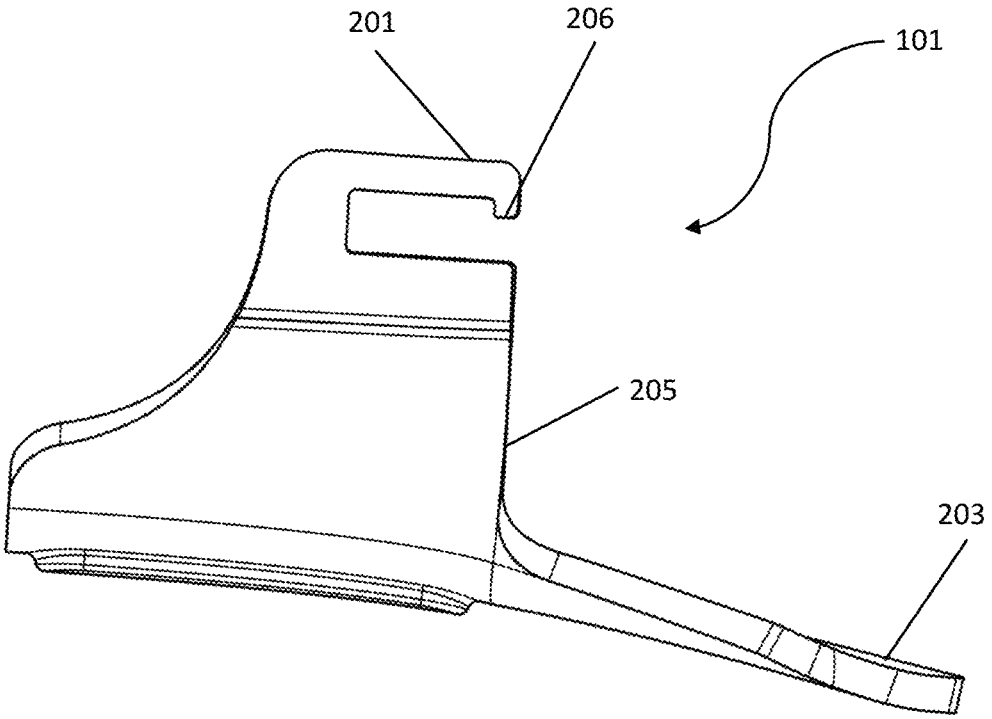

FIG. 2*c* shows a side view of an embodiment of a lower member 101. The side view shows a profile of an embodiment of a lower member 101, an extension 205, a notch 201 and a locking catch 206.

Figure 2D:
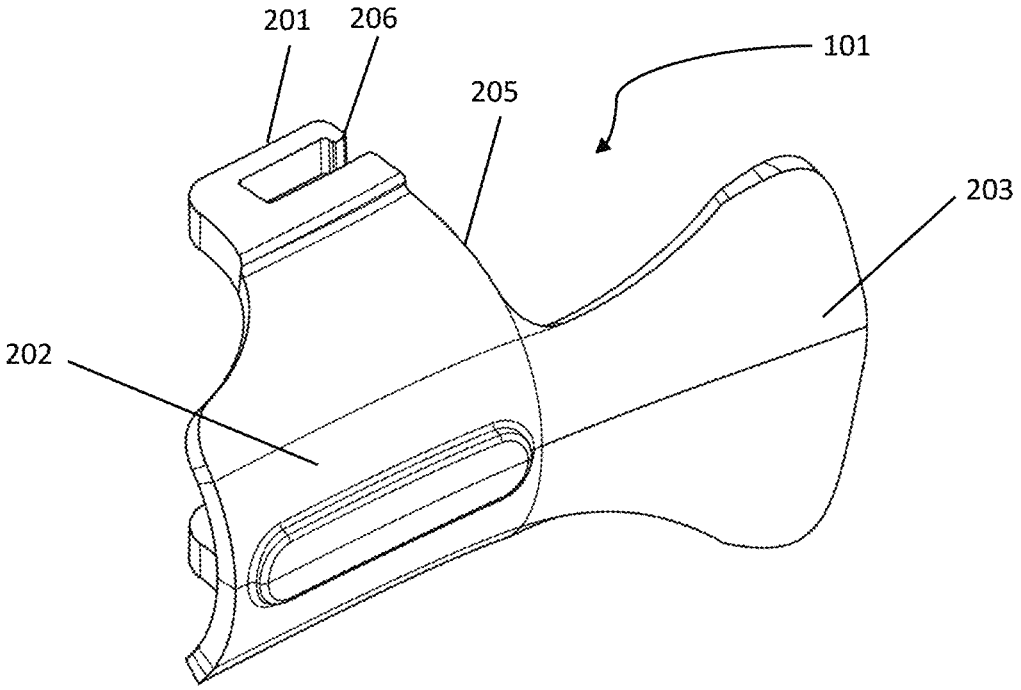

FIG. 2*d* shows a perspective view of the backside of an exemplary embodiment of a lower member 101, showing the backside of the cradle region 202 and tongue region 203, and showing an extension 205, notch 201 and locking catch 206.

According to an embodiment, the cradle region 202 may have two extensions 205 on either side of the instrument neck—one extension 205 may terminate in a hinged connection with the upper member 102, and the other extension 205 may terminate in a means to latch the upper member 102 with the lower member 101.

According to further embodiments, the lower member 101 may be sized and shaped to fit string instruments, at the headstock 107 and headstock-neck region 109, of different shapes and sizes. In embodiments, the curvature, radius, and shape of the tongue region 202 may vary to receive string instrument necks of differing shapes, sizes, and profiles. In further embodiments, the curvature, radius, and length of the extensions 205 may vary to receive string instrument necks of differing shapes, sizes, and profiles.

String instruments are produced in a wide range of angles between the fingerboard surface and the headstock—the headstock pitch. In embodiments, the angle between the cradle region 202 and tongue region 203 of the lower member 101 may vary to receive string instruments of varying headstock pitch. Standard headstock pitch in the string instrument industry range from 0°-25°, however this disclosure should not be read as limiting to such range.

String instruments are produced in a wide variety of headstock shapes and sizes. For example, smaller string instruments may have smaller headstocks, whereas larger instruments may have larger headstocks. Further, many string instrument manufacturers have "signature" headstock shapes and sizes unique to the manufacturer. Additionally, tuning machine design and layout on the instrument headstock varies greatly among string instruments. Therefore, in embodiments, the tongue region 203 of the lower member 101 may vary in shape and size to accommodate a vast array of headstock and tuning machine design, size, and layout.

In an embodiment, the lower member 101 may be made of stainless steel, carbon steel, brass, plastic, metal or other appropriate materials as required for a particular application, as understood by those of ordinary skill in the art. Further in an embodiment, the lower member 101 may be lined, where it makes contact with the instrument, with protective rubber, felt, or a similar protective layer known to those of ordinary skill in the art.

Figure 3A:
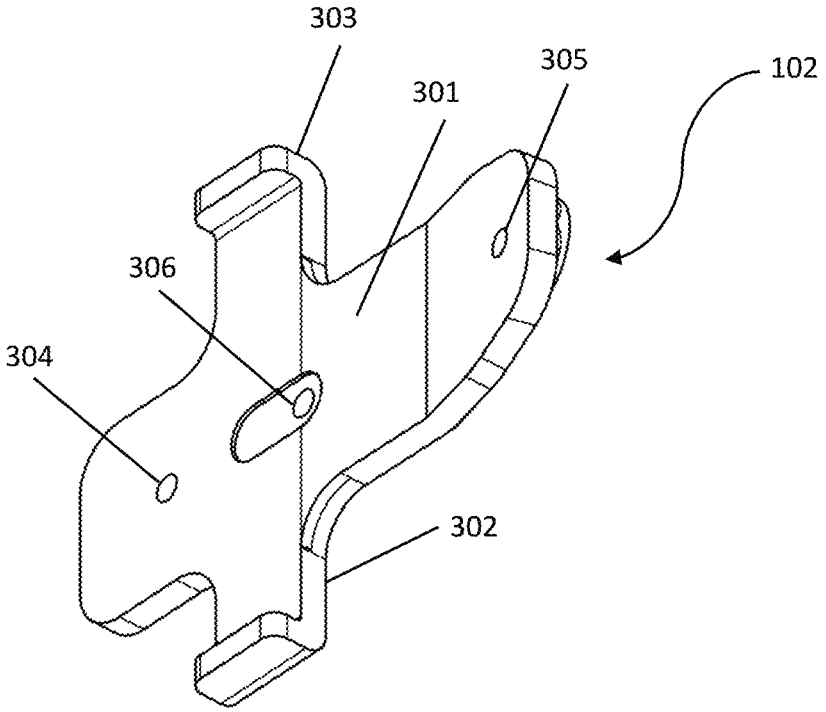
FIGS. 3*a*-3*c* show various views of an exemplary embodiment of an upper member ("Torque Cap") of an instrument headstock brace apparatus.
Figure 3B:
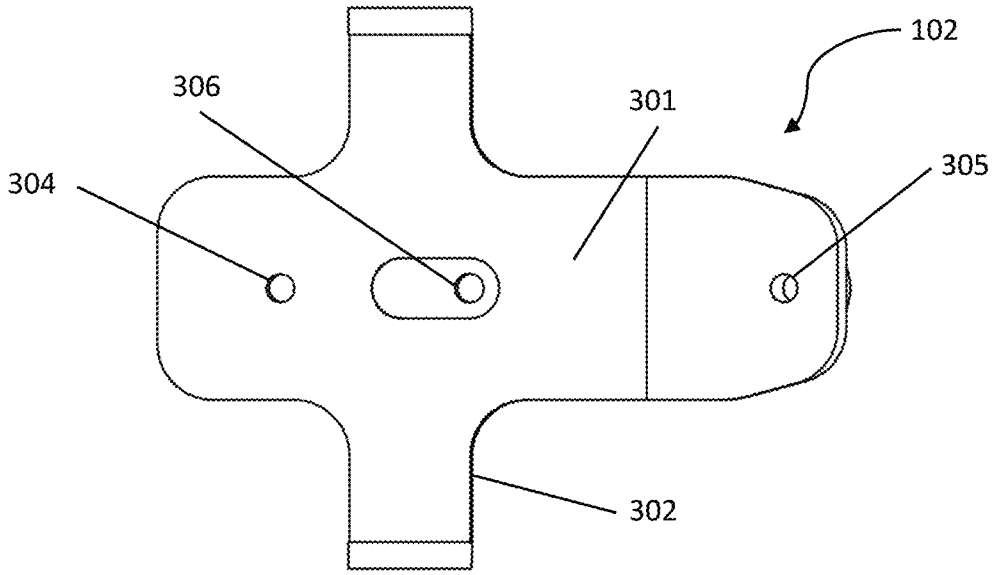
Figure 3C:
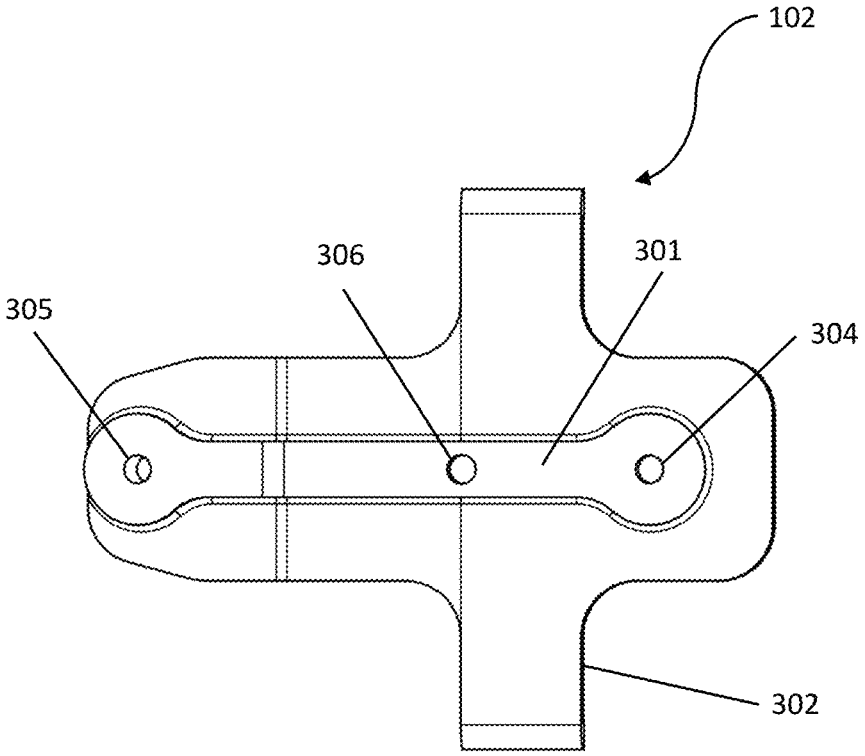

Exemplary FIGS. 3*a*-3*c* show various views of an embodiment of an upper member 102 of an instrument headstock brace apparatus. In particular, FIG. 3*a* shows a perspective view of the underside of an embodiment of an upper member 102. An embodiment of the upper member 102 may be described in two regions: a spine 301; and wings 302. The wings 302 may extend crosswise out of either side of the spine 301. The wings may terminate in bends 303.

In an embodiment, the upper member may have two threaded holes: a first threaded hole 304 over a string instrument's fingerboard; and a second threaded hole 305 over a string instrument's head stock. In an embodiment, the upper member may have a middle hole 306 at which a flat spring 106 (as shown in FIGS. 1*a* and 1*b*) may be attached.

FIG. 3*b* shows a bottom view of an embodiment of an upper member 102 of an instrument headstock brace apparatus showing a spine 301, wings 302, a first hole 304, a second hole 305, and a middle hole 306 at which a flat spring (not shown) may be attached.

FIG. 3*c* shows a top view of an embodiment of an upper member 101 showing a spine 301, wings 302, a first threaded hole 304, a second threaded hole 305, and a middle hole 306 at which a flat spring (not shown) may be attached. In an embodiment, the spine 301 may be reinforced, as an area of thicker material, on the top or bottom of the upper member 101.

Returning to FIG. 1*a*, according to an embodiment, wings 302 of the upper member 102 may be slotted into notches 201 of the lower member 101. Further according to an embodiment, bends 303 of the upper member 102 may then be useful to stabilize the upper member 102 within the lower member 101.

According to an embodiment, one wing 302 of an upper member 102 may be hingedly connected to a lower member 101, and the remaining wing 302 of the upper member 102 may contain a means to latch to the lower member 101.

According to an embodiment, an upper member 102 may have one threaded hole 305 over an instrument headstock 107 and a fixed means or protrusion (e.g., non-sprung and non-screw) for applying pressure to an instrument fingerboard. In a further embodiment, the upper member 102 may have a threaded hole 304 over an instrument fingerboard and a fixed means or protrusion for applying pressure to an instrument headstock. In a further embodiment, the upper member may have fixed means or protrusion for applying pressure to both a fingerboard and headstock (i.e. the upper member 102 is manufactured with a nonremovable, fixed means or protrusion, for applying pressure to a fingerboard and headstock).

In an embodiment, an upper member 102 may be made of stainless steel, carbon steel, brass, plastic, metal or other appropriate materials as required for a particular application, as understood by those of ordinary skill in the art.

Exemplary FIG. 1*b* shows a cross section view of an exemplary embodiment of a string instrument headstock brace apparatus in the context of use. According to an embodiment, a flat spring 106 may be attached to the underside of an upper member 102. The flat spring 106 may run from roughly the center of the underside of the upper member 102, down away from the upper member 102 and under the first screw 103 termination. The flat spring may be lined with a protective rubber, felt, or a similar protective layer known to those of ordinary skill in the art. According to embodiments, the flat spring 106 may aid in apparatus installation such that the flat spring 106 may push and hold the upper member 102 within the notches 201 and locking catches 206 of the lower member 101 before installation is completed by screwing down the first screw 103 and second screw 104.

According to embodiments, the placement and shape of the flat spring 106 may vary depending on the instrument to be braced and physical arrangement of the embodiment of the headstock brace apparatus.

According to embodiments, the flat spring 106 may be manufactured integrally and unitarily with the upper member 102.

In an embodiment, when the first screw 103 is unscrewed, the flat spring 106 may push against a fingerboard of a string instrument, holding the upper member 102 in place within the lower member 101 notches 201 before the first screw 103 and second screw 104 are tightened. In an embodiment, the first screw 103 may be tightened on top of the termination of the flat spring 106 over the string instrument fingerboard. The first screw 103 may be tightened to improve the distribution of stress in the notches 201, and improve the distribution of force on the upper member 102 and lower member 101 when apparatus installation is complete.

According to embodiments, the placement and shape of the flat spring 106 may vary depending on the instrument to be braced and physical arrangement of the embodiment of the headstock brace apparatus.

Returning to FIG. 1*a*, in an embodiment, the upper member 102 may have a second screw 104 over an area of the string instrument headstock. Upon installation, the second screw 104 may assert a force normal to the top of the instrument headstock in the direction of the rear of the string instrument. This force may counter the stress and strain in the headstock and headstock-neck region as asserted by the tension in the strings. Further, the force of the second screw 104 may firmly push and secure the headstock against the lower member 101 thereby bracing the headstock and headstock-neck region of the string instrument.

In an embodiment, the second screw 104 may terminate in a foot 105. The foot may give the second screw 104 a larger surface area over which to exert a force, thereby increasing the second screw's 104 effectiveness and decreasing the chances of damaging the instrument surface. According to an embodiment, the foot 105 may swivel in order to make flush contact with the string instrument headstock. According to an embodiment, the foot 105 may be stationary or fixed. In an embodiment, the underside of the foot 105 may be lined with protective rubber, felt, or similar protective layer known to those of ordinary skill in the art, so as to avoid damaging the instrument.

Still referring to FIG. 1*a*, according to embodiments, the area of the spine region 301 of an upper member 102 that extends over the instrument headstock may be angled as necessary to allow flush contact between the second screw 104 foot 105 and the headstock.

The above description and accompanying figures illustrate exemplary embodiments and modes of operation of the current invention. The invention should not be understood as being limited to the particular embodiments and examples discussed above. Additional embodiments will be appreciated by those of ordinary skill in the art.

What is claimed is:

1. A brace apparatus for a string instrument comprising:

a lower member; and an upper member;

wherein the lower member has a first end and a second end, the first end being shaped to receive, in a form-fitting manner, an underside of an upper area of a string instrument neck, and extending around the string instrument neck;

the second end of the lower member, extending from said first end, and extending into a region of, and being shaped to receive, in a form-fitting manner, an underside of a string instrument headstock; and wherein the upper member, being situated above a string instrument fingerboard, interfaces and connects with the lower member, the upper member being shaped and arranged to apply a first force and a second force normal to the string instrument in a direction toward a rear of the instrument and toward the lower member, the first force being applied to the string instrument fingerboard, and the second force being applied to the string instrument headstock.

2. The brace apparatus of claim 1, wherein the first force, to the string instrument fingerboard, is applied via an adjustable screw passing through the upper member and terminating such that the screw applies the first force to the string instrument fingerboard.

3. The brace apparatus of claim 1, wherein the second force, to the string instrument headstock, is applied via an adjustable screw traversing the upper member and terminating such that the screw applies the second force to the string instrument headstock.

4. The brace apparatus of claim 1, wherein the first force, to the string instrument fingerboard, is applied via a non-adjustable protrusion of the upper member, terminating such that the protrusion applies the first force to the string instrument fingerboard.

5. The brace apparatus of claim 1, wherein the second force, to the string instrument headstock, is applied via a non-adjustable protrusion of the upper member, terminating such that the protrusion applies the second force to the string instrument headstock.

6. The brace apparatus of claim 1, wherein the upper member interfaces and connects with the lower member above the string instrument finger board, the interface and connection being accomplished via lower member extensions protruding from the lower member around the string instrument neck and above the string instrument fingerboard, said extensions terminating in lower member notches;

the upper member having first and second crosswise wings; and said wings are shaped to slot into the lower member notches on either side of the string instrument above the string instrument fingerboard.

7. The brace apparatus of claim 6, wherein the lower member notches comprise self-locking catch protrusions such that when the upper member and lower member interface and connect, the self-locking catch protrusions prevent longitudinal movement between the lower member and upper member.

8. The brace apparatus of claim 1, wherein the upper member interfaces and connects with the lower member via a hinged connection between the lower member and upper member on one side of the apparatus, and via a latching mechanism between the upper member and the lower member on an opposing side of the apparatus.

9. The brace apparatus of claim 1, wherein the upper member interfaces and connects to the lower member via connecting screws.

10. The brace apparatus of claim 1, wherein the upper member comprises a flat spring connected to an underside of the upper member and directed toward the string instrument applying a third force to the upper member directed away from a top side of the string instrument.

11. The brace apparatus of claim 1, wherein the lower member is made of stainless steel, carbon steel, brass, plastic, or metal.

12. The brace apparatus of claim 1, wherein the lower member is made of stainless steel, carbon steel, brass, plastic, or metal.

* * * * *